United States Patent [19]

Sawyer

[11] 4,306,725

[45] Dec. 22, 1981

[54] THESAURUS CARD GAME

[76] Inventor: Hermon R. Sawyer, 562 Kendall, Palo Alto, Calif. 94406

[21] Appl. No.: 181,388

[22] Filed: Aug. 22, 1980

[51] Int. Cl.[3] ..... A63F 1/04

[52] U.S. Cl. ..... 273/302; 273/141 R; 273/299; 434/170

[58] Field of Search ..... 273/299, 302, 141 R, 273/292, 300; 434/167, 172, 170

[56] References Cited

U.S. PATENT DOCUMENTS 977,117 11/1910 McPherson ..... 273/299

3,448,983 6/1969 Foote ..... 273/141 R

*Primary Examiner*—Anton O. Oechsle

*Attorney, Agent, or Firm*—Harvey G. Lowhurst

[57] ABSTRACT

A card game comprising a pack of playing cards including fifty-two cards each having the same rectangular configuration and size and visually similar rear face. The front face of each card is divided into a first and second visually distinct zone, each of the first and second zones bearing the same readily recognizable letter of the alphabet and being either of one color or another color. Each zone of each card includes indicia of a different word representative of a selected subject of category of words followed by a dictionary definition. A spin dial in the nature of a board having a spinning pointer and an annular ring divided into fifty-two equal sectors allows spinning of the point with the head of the pointer eventually coming to rest on one of the sectors which uniquely identifies one of the fifty-two cards.

4 Claims, 3 Drawing Figures

THESAURUS CARD GAME

BACKGROUND OF THE INVENTION

This invention relates to an educational card game, and more particularly to a game utilizing a pack of cards and a spin dial pointing to indicia identifying a particular card.

Packs of playing cards comprising fifty-two cards, each denoting a different value of one of four common suits, such as clubs, diamonds, hearts, and spades, and ranging from a value of deuce through ace, have a long and ancient history and are well known. These cards are of generally rectangular shape and have generally identical sizes and rear faces, the front faces being different in denoting a suit and a value.

There are innumerable games that can be played with such a standard deck of cards, the most famous perhaps being bridge, gin rummy, canasta, to mention only a few. None of these card games is particularly educational in teaching a specific thing such as meaning of words or the translated language equivalent of words.

There are also many educational collections of cards in which one side of the card is provided with the word and the opposite side of the card is provided with some equivalent of the word, whether it be a definition or a language equivalent. However, these cards do not have any value or identification other than by group.

The intended purpose of playing the game of cards of the present invention is to assist a person in widening his vocabulary of words by providing the dictionary definition of certain words or, in case of a foreign language, by providing the foreign equivalent of certain words.

SUMMARY OF THE INVENTION

It is a primary object of the present invention to provide a new and improved pack of playing cards which include an individual identification as well as indicia allowing a user to increase his knowledge of whatever may be designated by the indicia.

It is a further object of the present invention to provide a new and improved game utilizing a spin dial pointing to a particular indicia and a deck of cards in which each indicia identifies a different card and in which the card provides a dictionary definition or a language equivalent of a word.

It is another object of the present invention to provide a card game, using a modified standard pack of cards, which can be used for playing an entertaining and an educational card game.

In accordance with the present invention, there is provided a pack of playing cards comprising fifty-two cards, each having the same rectangular configuration and size, and a visually similar rear face. The front face of each card is divided into a first and second visually distinctive zone, each of the first and second zones bearing the same readily recognizable letter of the alphabet selected from "A" through "Z", either in a first color or in a second color. Further, each of said first and second zones of each card includes indicia of a different word representative of a selected subject category of words, followed by a dictionary definition, each card including a different word in each zone. A spin dial in the nature of a board having a spinning pointer and an annular ring divided into fifty-two equal sectors allows spinning of the pointer with the head of the pointer eventually coming to rest on one of those sectors which uniquely identifies one of the fifty-two different cards.

DETAILED DESCRIPTION OF THE DRAWINGS

Figure 1:
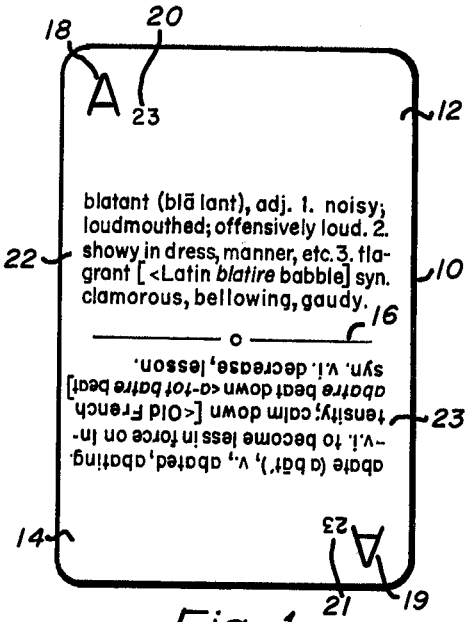
FIG. 1 shows a front face of a card comprising one of a pack of cards in accordance with the deck of cards of the present invention.

Referring now to FIG. 1, there is shown a front face of one playing card 10 of a deck of playing cards divided into a first zone 12 and a second zone 14 separated by a center line 16. In the upper left hand corner of first zone 12 is shown a space 18 occupied by one of the letters of the alphabet, in this case letter "A". Immediately adjacent to space 18 is a space 20 in which is placed the number "23" which has a meaning to be explained hereinafter. In the lower left hand corner, which is a mirror image of the upper right hand corner, is a space 19 which is occupied by the same letter as in space 18, except that it is inverted. This is also true of adjacent space 21 in which is placed the same number as space 20, only inverted. This inversion is well known from an ordinary deck of playing cards so that, as long as the card is held so that the narrow dimension is horizontal, the card does not have an up and down but each side is a proper side for viewing.

Underneath spaces 18 and 20 in first zone 12 is a space 22 which is utilized, in accordance with the present invention, to provide a word followed by a pronunciation in parenthesis, which is again followed by a substantially standard dictionary definition. Similarly, second zone 14 is provided with a space 23 which is occupied similarly to space 22, except that the word and definition relating to the word are different so that each card includes two different words, one in space 22 and one in space 23. This is dissimilar to the identification indicia of the card which is the same for spaces 18 and 19.

Spaces 20 and 21 indicate a number "23" which is uniquely related to the letter in spaces 18 and 19. In the English language, the letter "A" as the first letter of words is twenty-third in frequency of occurance, the most common letter being identified by the number "26" and the least common letter being the letter "x" and being identified by the numeral "1". It is of course to be understood that this scale may be reversed so that numeral "1" indicates the most commonly occuring first letter, whereas the number 26 would indicate the least commonly occuring first letter.

Referring once more to spaces 18 and 19, it is readily seen that a complete set of playing cards has fifty-two different cards, twenty-six cards being required for taking care of the alphabet from "A" through "Z", and the alphabet is used twice, each letter occuring in either one or another color. In this manner, fifty-two playing cards will have a hundred-four spaces, such as 22 and 23, and a full deck of cards can therefor provide definitions for one hundred and four different words. Alternatively, instead of utilizing a word with a dictionary definition, a word with a translation into another language might likewise be utilized.

Figure 2:
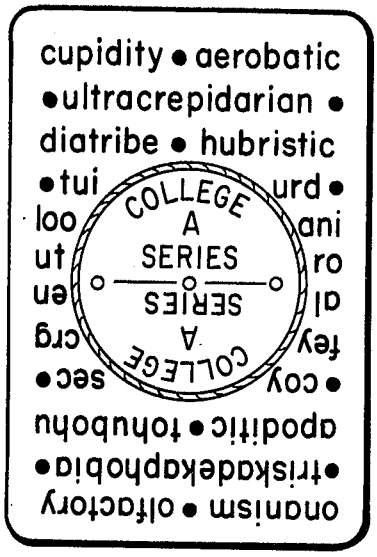
FIG. 2 shows the common rear face of all fifty-two cards of the deck of cards of the present invention.

Referring now to FIG. 2 of the drawing, there is shown a common rear face which is similar for the entire deck of cards and which may include, as shown, some identification of a subject category of words in spaces 22 and 23.

Figure 3:
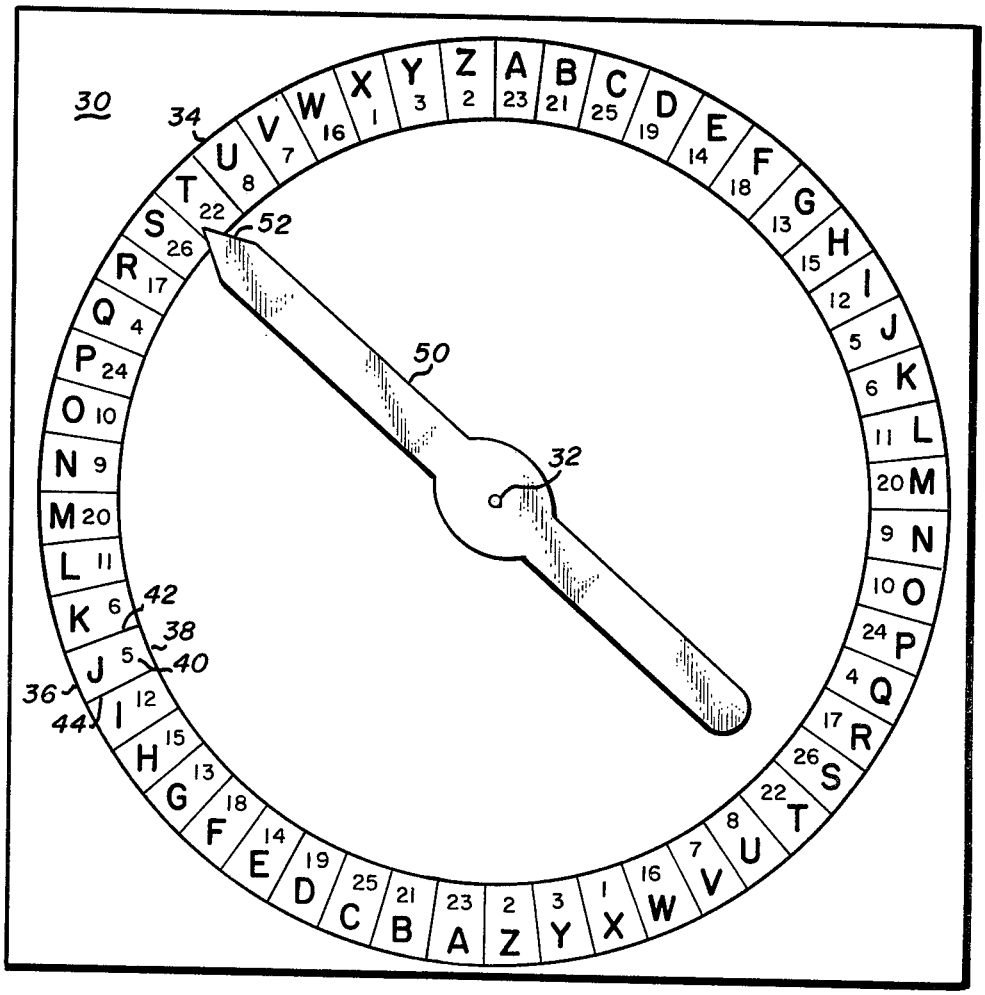
FIG. 3 shows a spin dial, including a pointer, for playing the instant invention.

Referring now to FIG. 3, there is shown a board 30 including a center 32 and an annular ring 34 disposed around center 32. Annular ring 34 has an outer border 36 and an inner border 38 and is divided into one hundred and four equal sectors such as sector 40 defined by radial lines 42 and 44. Disposed in each sector 40 is a letter of the alphabet from "A" through "Z" in either one color or another color, to match with the colors of the letters in spaces 18 and 19 of the playing cards, and these letters may be arranged sequentially as shown in FIG. 3 or may be mixed up in any fashion whatsoever. Underneath the letters in each sector is also the number which indicates the same number as in space 20 which is related to the letter as indicating its frequency as the first letter of words in a particular language.

There is also provided a spin pointer 50 which has a head portion 52 which is disposed to point to a particular sector 40 and to define that sector uniquely. Pointer 50 is pivotively supported on center 32 by means of a pin or the like so that it can be freely spun allowing some revolutions before it comes to rest.

There are many ways in which the deck of cards in this invention, together with the spin dial, can be utilized for playing a game. For example, four people can sit around a table and each player is provided with thirteen cards. Then one player is designated to spin the dial and the person that has the card identified in sector 40 on which pointer head 52 comes to rest may ask a designated person, such as the person sitting opposite him, whether he knows the definition of a certain word on his card. If the person does know the word certain credits will be assigned.

The game may also be played with two or several players, odd or even numbers. A deck may be comprised of one or two categories of words, each category being represented by a different color.

An entertaining and instructive game of solitary, without the spin dial, may be played by an individual. The number adjacent to each letter on the face of the cards and on the dial, which indicate a value of each letter, may or may not be used in the game at the option of the players. The primary purpose of the "letter value" is to provide a special aleatory (chance) factor to the game if the players chose to use it.

What has been described in here is a new card deck which has a standard number of fifty-two playing cards and which is identified by a letter of the alphabet either in one color or another color. On the card itself is a word and some indicia relating to the word for playing an educational game. There is also provided a spin dial divided into fifty-two sectors with a rotatable pointer which can be activated by a player and which comes to rest on a definite sector uniquely identifying the same.

What is claimed is:

1. A pack of playing cards comprising:

fifty-two cards, each of said cards being generally of the same rectangular configuration and standard size and having visually similar rear faces;

each of said cards being split to define a front face divided into first and second visually distinctive zones;

the first and second zone of each card bearing the same readily recognizable letter of the alphabet selected from "A" through "Z" either in a first color or a second color, each card differing from each other by either bearing a different letter or by having the same letter but of a different color; and each of said first and second zone of each card further including indicia of a different word representative of a selective subject category of words and the dictionary definition of the word immediately following the word so that the pack of cards includes one-hundred and four different such words.

2. A pack of cards in accordance with claim 1 in which the identifying letter in each zone is followed by a number from 1 through 26 which identifies the relative standing of the letter as the first letter of words in the language of the words in said zones.

3. A game comprising:

a pack of fifty-two playing cards, each of said cards being generally of the same rectangular configuration and standard size and having visually similar rear faces;

each of said cards being split to define a front face divided into first and second visually distinctive zones;

the first and second zone of each card bearing the same readily recognizable letter of the alphabet selected from A through Z either in a first color or a second color, each card differing from each other card by either bearing a different letter or by having the same letter but of a different color; and each of said first and second zone of each card further including indicia of a different word representative of a selective subject category of words and the dictionary definition of the word immediately following the word so that the pack of cards includes one-hundred and four such words; and a spin dial including a board having a center, an annular ring around said center which is divided into fifty-two equal sectors, each sector including indicia representative of a different letter of the alphabet or the same letter in either said first color or said second color, and a pointer pivotally mounted for rotation about said center, the pointer having a pointed head portion which is disposed so that its point identifies one of said sectors.

4. A game comprising:

a pack of N different playing cards, each of said cards being generally of the same rectangular configuration and standard size and having visually similar rear faces;

each of said cards being split to define a front face divided into first and second visually distinctive zones;

the first and second zone of each card bearing the same readily recognizable identifier and every card differing from every other card by bearing a different identifier;

each of said first and second zone of each card further including indicia of one different word representative of a selective subject category of words, and the dictionary definition of the word immediately following the word, so that the pack of cards includes 2N different words; and a spin dial including a board having a center, an annular ring around said center which is divided into N equal sectors, each sector including indicia representative of a different one of each of said identifiers, and a pointer pivotally mounted for rotation about said center, the pointer having a pointed head portion which is disposed so that its point identifies one of said sectors.

* * * * *